US009961458B1

(12) United States Patent
Tourdot

(10) Patent No.: US 9,961,458 B1
(45) Date of Patent: May 1, 2018

(54) HEARING AID SLEEVE

(71) Applicant: IntriCon Corporation, Arden Hills, MN (US)

(72) Inventor: William E. Tourdot, St. Paul, MN (US)

(73) Assignee: IntriCon Corporation, Arden Hills, MN (US)

( * ) Notice: Subject to any disclaimer, the term of this patent is extended or adjusted under 35 U.S.C. 154(b) by 0 days. days.

(21) Appl. No.: 15/357,090

(22) Filed: Nov. 21, 2016

Related U.S. Application Data

(60) Provisional application No. 62/413,868, filed on Oct. 27, 2016.

(51) Int. Cl.
*H04R 25/00* (2006.01)

(52) U.S. Cl.
CPC ..... *H04R 25/65* (2013.01); *H04R 25/602* (2013.01); *H04R 25/604* (2013.01); *H04R 25/652* (2013.01); *H04R 25/658* (2013.01); *H04R 2225/023* (2013.01); *H04R 2225/025* (2013.01); *H04R 2460/09* (2013.01); *H04R 2460/17* (2013.01)

(58) Field of Classification Search
CPC .... H04R 25/456; H04R 25/60; H04R 25/652; H04R 25/656; H04R 25/658; H04R 2210/10; H04R 2225/023; H04R 2225/025; H04R 2460/11; H04R 2460/15; H04R 2460/17
USPC ..... 381/322, 324, 328, 329, 330, 380; 181/129, 130, 135
See application file for complete search history.

(56) References Cited

U.S. PATENT DOCUMENTS

| | | | | |
|---|---|---|---|---|
| 2,430,229 | A | 11/1947 | Kelsey | |
| 4,869,339 | A * | 9/1989 | Barton | H04R 25/652 181/135 |
| 4,870,688 | A | 9/1989 | Voroba et al. | |
| 5,979,589 | A | 11/1999 | Aceti | |
| 6,179,085 | B1 * | 1/2001 | Brimhall | H04R 25/652 181/135 |
| 6,359,993 | B2 | 3/2002 | Brimhall | |
| 7,519,193 | B2 | 4/2009 | Fretz | |
| D671,218 | S | 11/2012 | Daavettila et al. | |
| 8,355,517 | B1 | 1/2013 | Fretz | |
| 8,358,797 | B2 | 1/2013 | Fretz | |
| 8,605,927 | B2 | 12/2013 | Fretz et al. | |
| 8,625,834 | B2 | 1/2014 | Smith et al. | |
| 8,767,987 | B2 | 7/2014 | Fretz | |
| 9,479,856 | B2 | 10/2016 | Smith et al. | |

(Continued)

*Primary Examiner* — Huyen D Le
(74) *Attorney, Agent, or Firm* — Shewchuk IP Services, LLC; Jeffrey D. Shewchuk

(57) ABSTRACT

A compressible, flexible shape-retaining sleeve fits around a hearing aid shell. The sleeve includes fins having a fold line which extend outward to contact the user's ear canal, changing the hearing aid from being largely non-occlusive to being substantially occlusive. The hearing aid, including its shell, can be repeatedly inserted and removed from the sleeve through the battery door opening. The sleeve also has openings for a flexible filament positioning structure, consistently positioning the hearing aid for both occlusive and non-occlusive use. While the flexible filament positioning structure is attached to the hearing aid, it prevents disengagement of the sleeve from the hearing aid shell during insertion and removal of the hearing aid from the user's ear canal.

20 Claims, 6 Drawing Sheets

(56) References Cited

U.S. PATENT DOCUMENTS

| | | | |
|---|---|---|---|
| 2007/0019832 | A1 | 1/2007 | Bordewijk |
| 2009/0034775 | A1 | 2/2009 | Burton |
| 2009/0074220 | A1 | 3/2009 | Shennib |
| 2009/0316940 | A1 | 12/2009 | Pander et al. |
| 2014/0198939 | A1 | 7/2014 | Pander et al. |

* cited by examiner

HEARING AID SLEEVE

CROSS-REFERENCE TO RELATED APPLICATION(S)

The present application claims the benefit of U.S. provisional patent application Ser. No. 62/413,868, filed Oct. 27, 2016. The contents of U.S. provisional patent application Ser. No. 62/413,868 are hereby incorporated by reference in entirety.

BACKGROUND OF THE INVENTION

The present invention relates to hearing aids. In particular, the present invention pertains to sleeves and exterior housing structures for hearing aids. The invention is intended particularly for use with a hearing aid and hearing aid positioning system and structure such as those disclosed in U.S. Pat. No. 8,605,927, incorporated herein by reference, with the preferred embodiment being adapted for use with a hearing aid positioning system and structure most similar to the third embodiment described in U.S. Pat. No. 8,605,927. That hearing aid has the electronic components within a protective polymer shell which is supportable in a non-occlusive manner within the user's ear canal by the positioning structure.

Hearing aids on the market today are available in different mounting configurations. Many hearing aids include a behind-the-ear ("BTE") portion which, as the name implies, is mounted behind the user's ear, typically including a sound tube which extends into the user's ear canal to transmit sound from the speaker (called a "receiver" in the hearing aid field, thereby minimizing confusion with a person speaking) contained within the BTE portion. Other hearing aids are considered in-the-ear ("ITE") hearing aids with some or all of the weight of the hearing aid supported in the conchae bowl of the user's ear. Many hearing aids also include a portion which resides in the user's ear canal, including receiver-in-canal ("RIC") hearing aids which have only the receiver of the hearing aid in the ear canal, in-the-canal ("ITC") hearing aids which extend largely into the ear canal but include a portion outside the ear canal, or completely-in-canal ("CIC") hearing aids which reside entirely in the user's ear canal. Some ITC and CIC hearing aids have used a flexible retrieval line for removing the hearing aid from the ear canal.

In all these hearing aids, trade-offs are made in determining what will be perceived as best sound quality and in weighing sound quality against best comfort of the hearing aid as well as aesthetically. Aesthetically, most users desire a hearing aid which is as inconspicuous as possible, which in turn typically favors placing as much of the hearing aid as deeply in the user's ear canal as possible. Sound quality is somewhat dependent upon proximity of the hearing aid's sound outlet to the eardrum, and placement (depth of canal insertion) affects sound quality more heavily in ITC and CIC hearing aids.

Both sound quality and comfort are also impacted by the degree which the hearing aid "occludes" the ear canal. For some users, minimal occlusion is desired, so ambient sound can reach the user's ear drum through the open space in the ear canal around whichever part of the hearing aid resides in the ear canal. Minimal occlusion helps to avoid any pressure points on the user's ear tissue, and aids in pressure equalization across the ear drum. For other users, significant occlusion is desired. Significant occlusion prevents ambient sound from reaching the user's ear drum, so all (or nearly all) of the sound heard can be modified and amplified through the hearing aid electronics. Significant occlusion also restricts the sound feedback path from the sound outlet back to the hearing aid microphone, particularly important if the microphone inlet is near the sound outlet. Restricting the sound feedback path can allow for higher gains (i.e., more amplification) without the loud and annoying whistles and cracks which can result if sound is repeatedly amplified in a feedback loop.

One part of the difficulty in designing hearing aids is that the anatomical shapes of different users' ears are not uniform. To achieve accurate and consistent placement in the desired location relative to a user's eardrum, many hearing aids use a custom shell which is custom shaped to fit that particular user's shape of ear anatomy. However, customization of the shell involves significant costs which can be avoided with a less customized solution.

For many RIC, ITC and CIC non-custom hearing aids, placement is largely set by the user, i.e., the user pushes the hearing aid (or canal portion) into the ear canal sufficiently far that it comfortably seats in a desired ear canal location by biasing off the wall of the ear canal. A large part of the consistent placement of such RIC, ITC and CIC non-custom hearing aids relies on the gradually decreasing diameter of the ear canal, i.e., the user pushes the hearing aid into the canal until it feels snug but not overly tight. How far the hearing aid is pushed into the ear canal can also result in different amounts of occlusion from user to user and with a single user from one placement to another placement. As more hearing aid solutions become available, proper placement methods for non-custom hearing aids that do not rely on "snugness" in the ear canal are needed.

BRIEF SUMMARY OF THE INVENTION

The present invention is a sleeve which fits around a hearing aid shell. The sleeve is formed of a soft, pliable, shape-retaining material, which is biocompatible to allow contact with the skin of the user's ear canal. The interaction between the sleeve and the ear canal changes the hearing aid from being largely non-occlusive to being substantially occlusive. The hearing aid, including its shell, can be inserted and removed from the sleeve by the user or the user's audiologist, allowing the user to choose whether to use the hearing aid in an occlusive or in a non-occlusive manner. The sleeve permits the hearing aid position in the ear canal to be largely or entirely determined by a flexible filament positioning structure, consistently for both occlusive and non-occlusive use. The interaction between the sleeve and the flexible filament positioning structure prevents disengagement of the sleeve from the hearing aid shell during insertion and removal of the hearing aid from the user's ear canal.

While the above-identified drawing figures set forth a preferred embodiment, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

Figure 2:
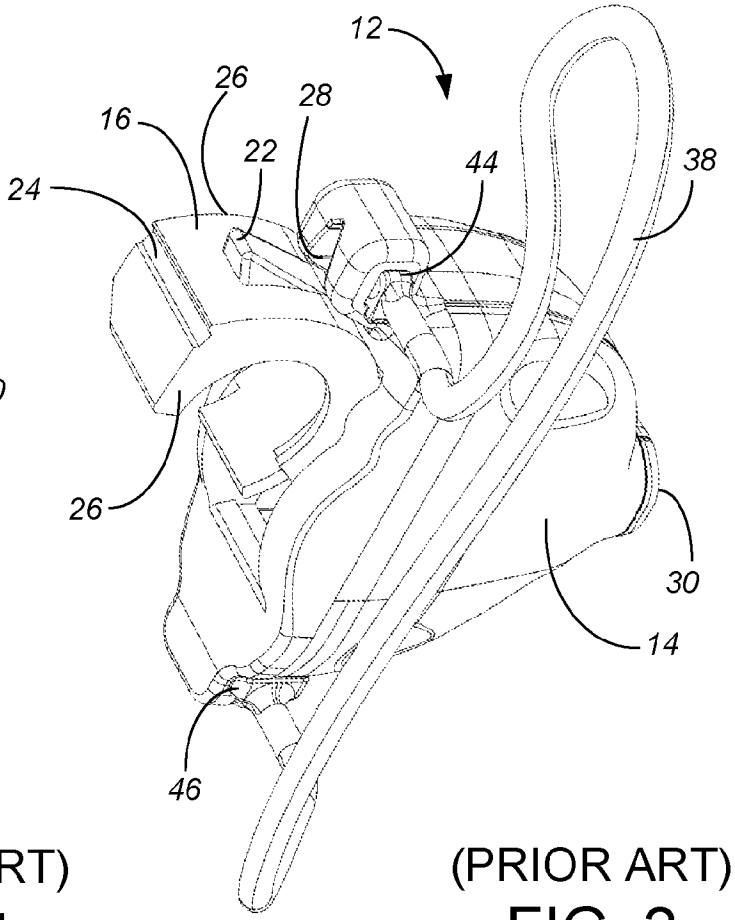
(PRIOR ART) FIG. 2
FIG. 2 is a second perspective view of the prior art hearing aid of FIG. 1.
Figure 1:
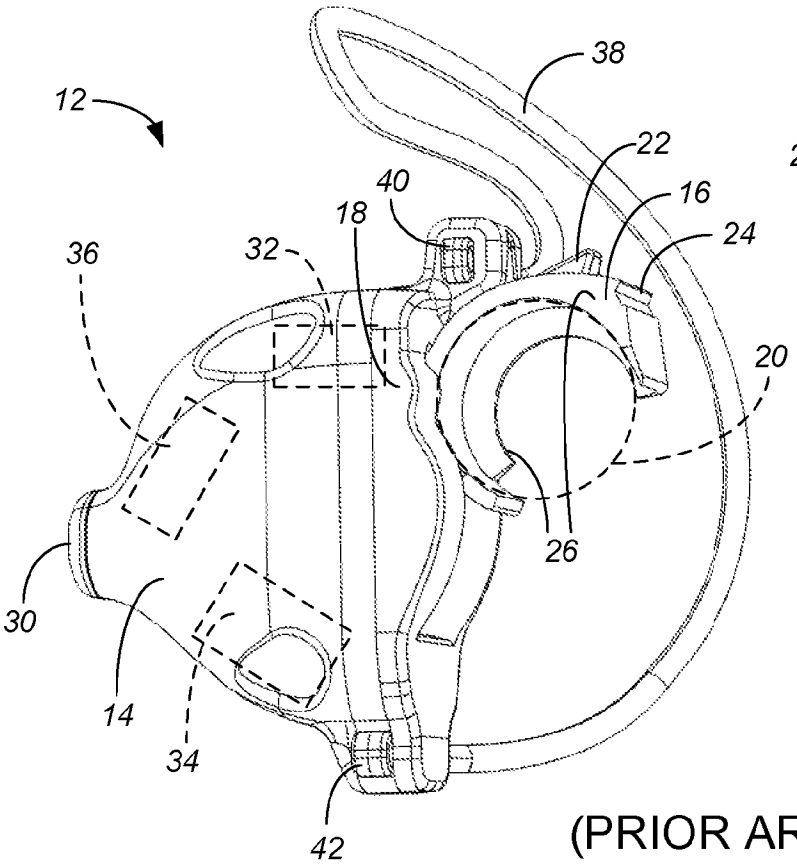
(PRIOR ART) FIG. 1
FIG. 1 is a perspective view of a prior art hearing aid for use with the hearing aid sleeve of the present invention, configured for use in a left ear and with the battery door open.
Figure 4:
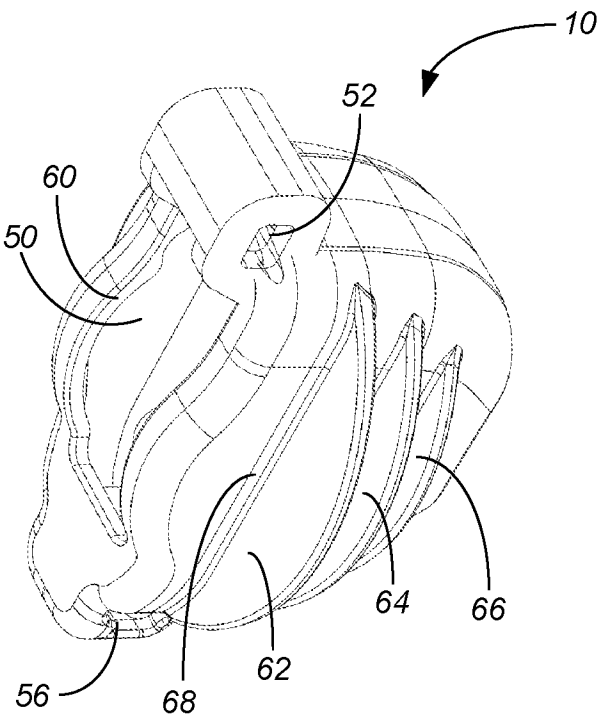
FIG. 4 is a second perspective view of a hearing aid sleeve of the present invention for use with the hearing aid of FIGS. 1 and 2, shown from the same angle as the hearing aid of FIG. 2.
Figure 3:
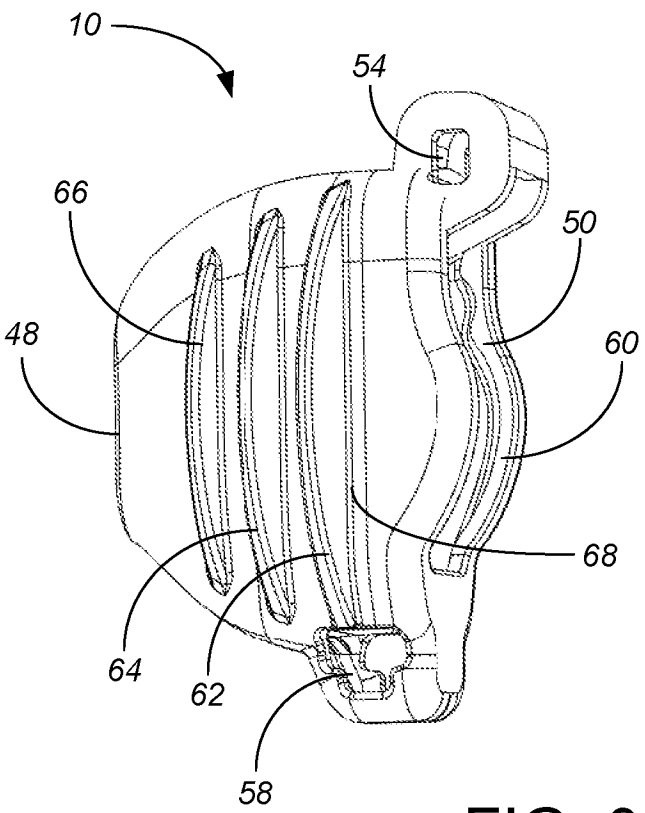
FIG. 3 is a perspective view of a hearing aid sleeve of the present invention for use with the hearing aid of FIGS. 1 and 2, shown from the same angle as the hearing aid of FIG. 1.
Figure 5:
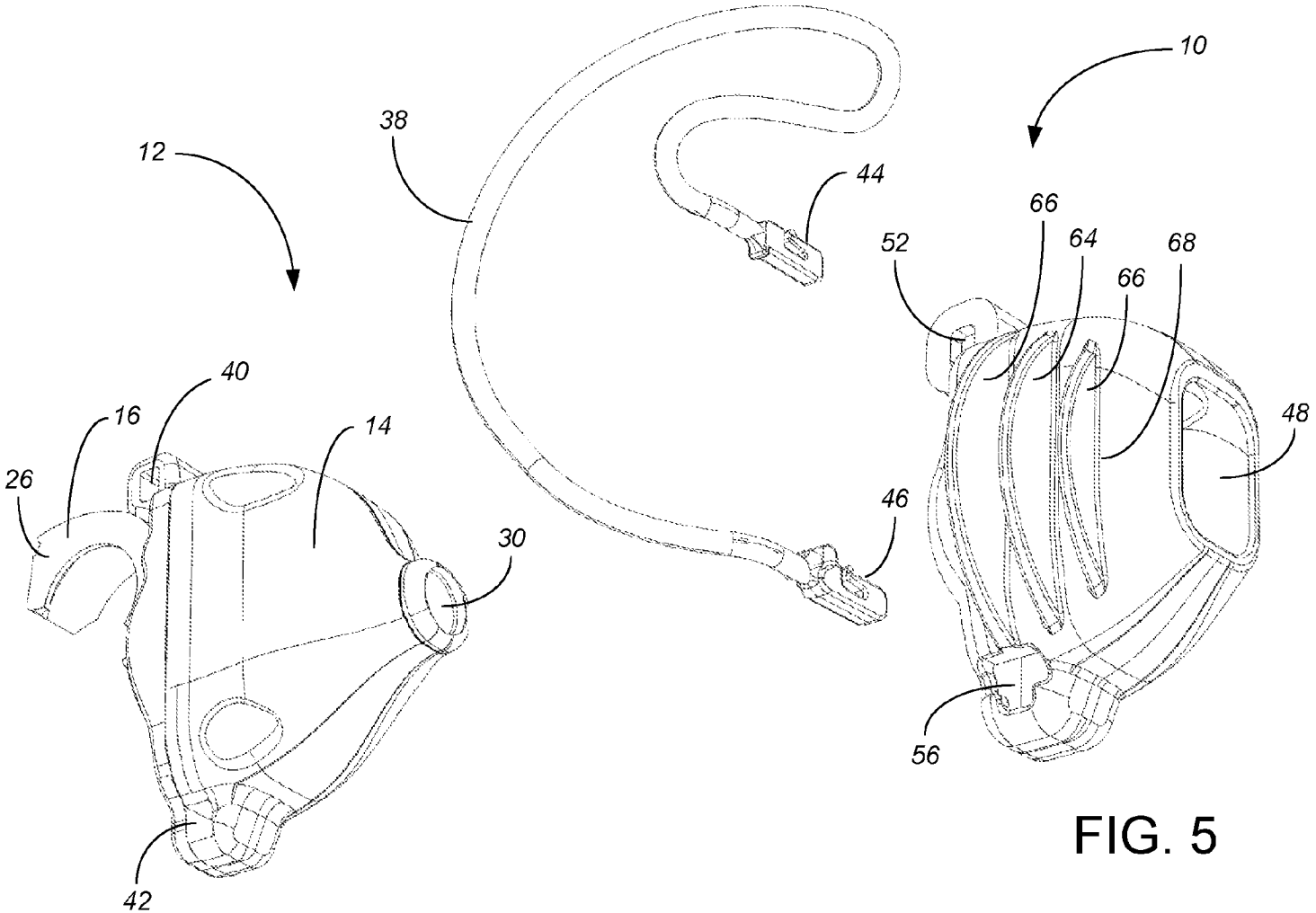
FIG. 5 is a perspective, assembly view of the hearing aid sleeve of FIGS. 3 and 4 with the hearing aid of FIGS. 1 and 2.
Figure 6:
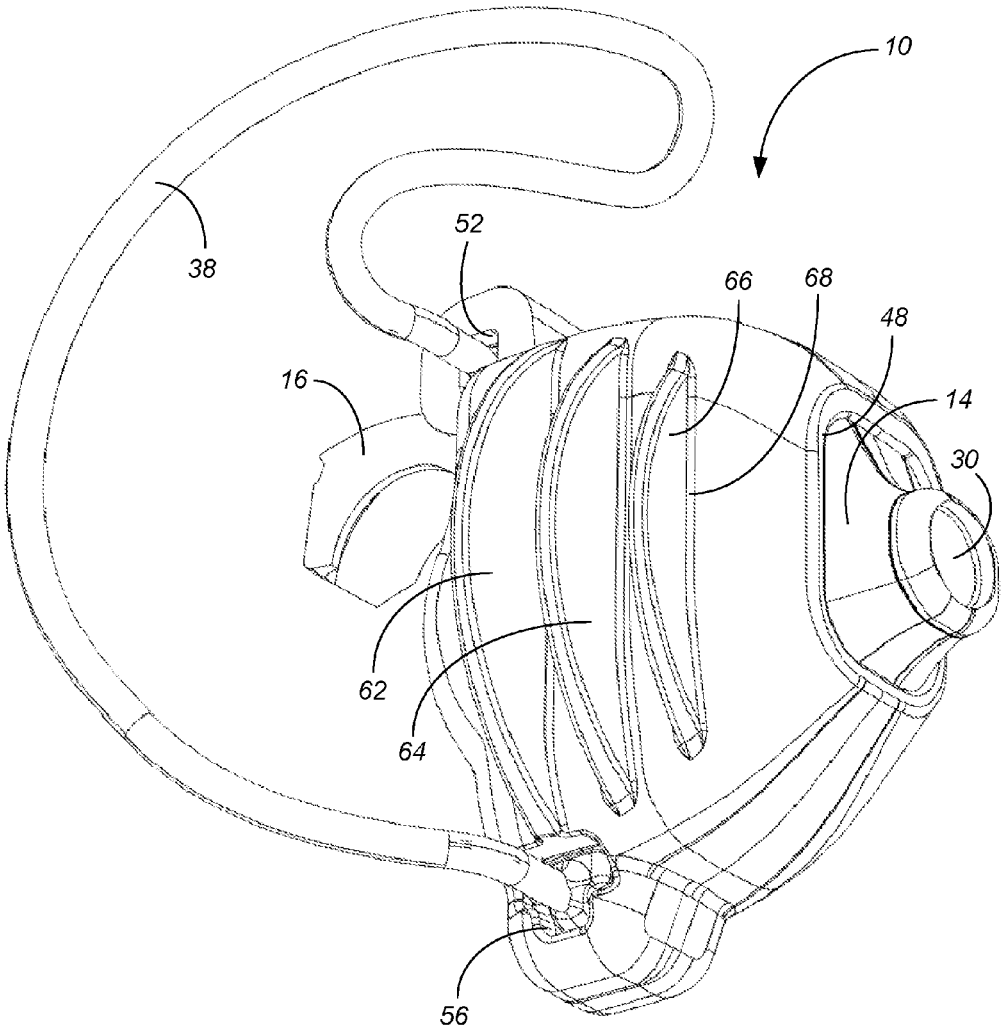
FIG. 6 is a perspective, assembled view of the hearing aid sleeve of FIGS. 3 and 4 on the hearing aid of FIGS. 1 and 2, shown from the same angle as FIG. 5.
Figure 7:
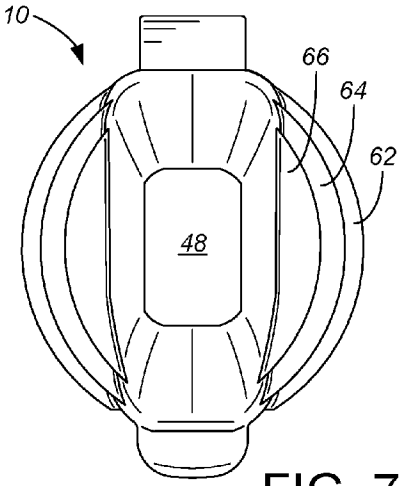
FIG. 7 is a distal end view of the hearing aid sleeve of FIGS. 3-6.
Figure 8:
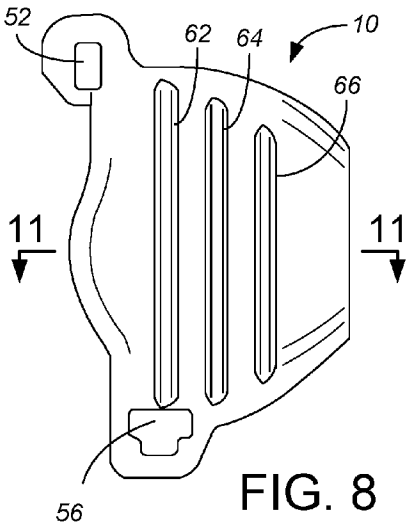
FIG. 8 is a side view of the hearing aid sleeve of FIGS. 3-7.
Figure 9:
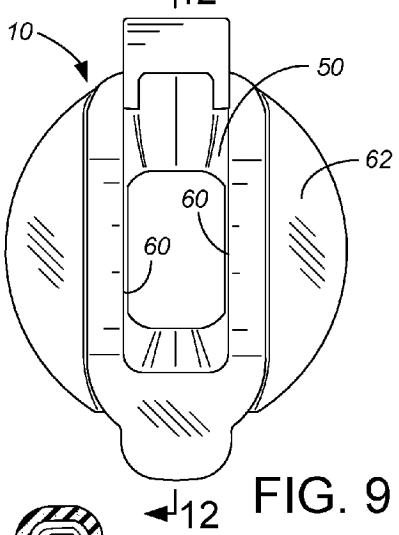
FIG. 9 is a proximal end view of the hearing aid sleeve of FIGS. 3-8.
Figure 11:
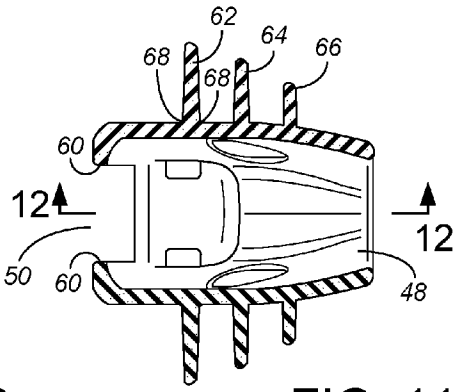
FIG. 11 is a generally horizontal cross-sectional view of the hearing aid sleeve of FIGS. 3-10, taken along lines 11-11 in FIG. 8.
Figure 10:
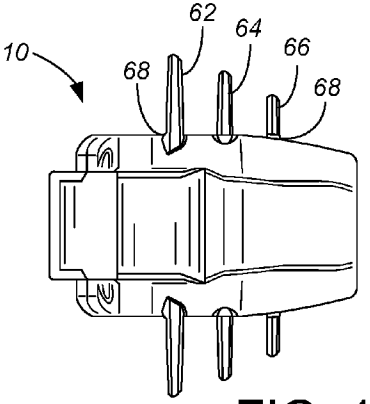
FIG. 10 is a bottom plan view of the hearing aid sleeve of FIGS. 3-9.
Figure 12:
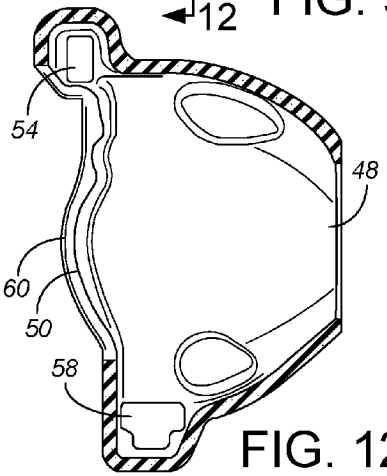
FIG. 12 is a generally vertical cross-sectional view of the hearing aid sleeve of FIGS. 3-11, taken along lines 12-12 in FIGS. 9 and 11.

The present invention is a hearing aid sleeve 10 for use around a hearing aid 12, such as the prior art hearing aid 12 shown in FIGS. 1 and 2. This particular prior art hearing aid 12 is an APT hearing aid of IntriCon Corporation, assignee of the present invention. Various aspects of the APT hearing aid 12 are described and disclosed in U.S. Pat. Nos. D671,218, 7,519,193, 8,355,517, 8,358,797, 8,605,927 and 8,767,987, all incorporated by reference. In general terms, the hearing aid 12 includes a hearing aid shell 14 with electronic components contained therein. A battery door 16 is hinged to the hearing aid shell 14 about a pivot axis 18, allowing opening and closing for insertion and removal of a hearing aid battery 20 (shown schematically only in FIG. 1). The battery door 16 may have a thumbnail clasp 22 for use in opening the door 16 and a detent 24 for snapping the battery door 16 shut relative to the hearing aid shell 14, as well as two opposing edges 26 running between the hinge side and the clasp side. A microphone sound inlet opening 28 may be on a proximal side of the shell 14. A sound outlet opening or port 30, from which sound output from the hearing aid 12 is projected, is on a distal end of the shell 14. In addition to the battery 20, the hearing aid electronics inside the shell 14 include a microphone 32 (shown schematically only in FIG. 1) for sensing sound and converting sound into an electrical signal, a signal processor 34 (shown schematically only in FIG. 1), typically digital (a/k/a a "DSP"), for processing the electrical signal from the microphone 32 including amplifying various frequencies or sound components as appropriate for the hearing loss or needs of the user, and a receiver 36 (shown schematically only in FIG. 1) which converts the processed electrical signal into sound to be heard by the user. All of the microphone 32, signal processor 34 and receiver 36 are powered by electrical connections with the battery 20. The hearing aid shell 14 is sufficiently small to be substantially received in a user's ear canal without causing occlusion of the user's ear canal. In the preferred embodiment, the APT hearing aid 12 has an oblong shape which is about ½ inch tall and ½ inch deep, with a thickness or width of about ⅙ of an inch. The hearing aid 12 is inserted into the ear canal with an insertion direction from proximal to distal, i.e., with the sound outlet port 30 deeper into the ear canal and with the microphone sound inlet opening 28 and battery door 16 facing out of the ear canal.

In preferred embodiments, the hearing aid shell 14 is injection molded of a biocompatible polymer material in two shell portions, with the electrical components 32, 34, 36 mounted into the shell portions before the two shell portions are adhesively attached or welded (such as sonically welded) together. The shell material is typically somewhat rigid and protects the electronic components 32, 34, 36 and connections housed therein.

The hearing aid 12 is sized to be largely received in the ear canal in a non-occluding position. Instead of biasing with a snug fit against the tissue of the ear canal, the hearing aid 12 is positioned by a flexible filament 38. The flexible filament 38 extends outside the profile of the hearing aid shell 14, and interacts with ear structure exterior to the canal. The interaction between the flexible filament 38 and the user's ear anatomy determines an unoccluded insertion depth of the hearing aid shell 14 into the user's ear canal by preventing the hearing aid 12 from being pushed too deep into the ear canal by the user. In addition to determining insertion depth, the flexible filament 38 permits the user to remove the hearing aid 12 from the user's ear canal by pulling on the flexible filament 38.

The hearing aid shell 14 includes a top clip opening 40 and a bottom clip opening 42, both for receiving corresponding clip ends 44, 46 on the flexible filament 38. The flexible filament 38 is in the shape of a D-ring loop, extending from a top clip 44 to a bottom clip 46. The particular flexible filament 38 shown is for a left ear, clipping into the hearing aid shell 14 from a right side. A mirror image of the flexible filament 38 can alternatively be provided for a right ear, clipping into the hearing aid shell 14 from a left side.

The flexible filament 38 is formed of a flexible, shape-retaining, biocompatible material which is more flexible than the generally rigid material of the hearing aid shell 14. The preferred hearing aid shell 14 is bilaterally symmetrical, so the hearing aid 12 can be equally used in either the right or left ear depending upon which flexible filament positioning structure 38 is used. For both left and right versions, the flexible filament 38 can be manufactured in different sizes, to thereby better fit different sized left and right ears via a single non-custom manufactured (but custom programmed) hearing aid 12.

The present invention is a sleeve 10 which fits around a hearing aid shell 14, a preferred embodiment of which is shown in FIGS. 3-12. The sleeve 10 fits around the hearing aid shell 14 without obstructing either the sound outlet opening 30 or the microphone inlet opening 28. The preferred sleeve 10 also allows free movement of the battery door 16 from a closed to an open position, so the hearing aid battery 20 can be replaced while the sleeve 10 remains on the hearing aid 12. The preferred sleeve 10 also allows access to both the top clip opening 40 and the bottom clip opening 42, for attachment and detachment of the flexible filament positioning structure 38. In the preferred embodiment, the sleeve 10 is bilaterally symmetrical like the hearing aid 12, so the hearing aid 12 and sleeve 10 can be equally used in either the right or left ear depending upon which positioning structure 38 is used.

The interior dimensions and shape of the sleeve 10 match the size and shape of the exterior of the hearing aid shell 14 for which the sleeve 10 is designed to be used. In the preferred embodiment, the sleeve 10 is a hollow structure with six openings: a distal sound outlet opening 48, a larger proximal opening 50 which allows access to both the battery door 16 and the microphone sound inlet opening 28; two small right and left openings 52, 54 for the top clip 44, and two small right and left openings 56, 58 for the bottom clip 46. Each of these clip openings 52, 54, 56, 58 can extend around either the flexible filament 38 or a portion of the hearing aid shell 14 receiving the flexible filament 38.

The wall thickness of the sleeve 10 depends upon the material from which it is formed, but should be generally selected to be as thin as possible around the hearing aid 12 while still securely holding the hearing aid 12. In the preferred embodiment, the general wall thickness of the sleeve 10 is about $1/50^{th}$ of an inch thick surrounding the hearing aid 12.

The sleeve 10 is formed of a soft, pliable, shape-retaining material, which is biocompatible to allow contact with the skin of the user's ear canal. In the preferred embodiment, the sleeve 10 is molded of a WHACKER R4-3/30 silicone. The material of the sleeve 10 is softer and more compressible than the hearing aid shell 14. The material of the sleeve 10 is also elastically stretchable, enabling the battery door opening 50 to be sufficiently stretched to insert the hearing aid shell 14 into the sleeve 10 through the battery door opening 50, and sufficiently stretched to remove the hearing aid shell 14 from the sleeve 10 through the battery door opening 50. The elastic properties of the sleeve material allow the hearing aid 12 to be inserted and removed through the battery door opening 50 of the sleeve 10 multiple times during the life of the sleeve 10. For instance, in the preferred embodiment that battery door opening 50 has an oblong shape which mirrors but is slightly smaller than the oblong shape of the hearing aid 12, such as a rectangular opening 50 of about $1/7^{th}$ of an inch wide and ⅓ of an inch tall. The battery door 16 on the preferred hearing aid 12 is likewise about $1/7^{th}$ of an inch wide (such that the opposing edges 26 of the battery door 16 are narrower than the $1/6^{th}$ inch thick hearing aid shell 14), permitting hand manipulation of the APT hearing aid 12 through the battery door opening 50 when desired, but also providing two lips 60 on the sleeve 10 adjacent the two opposing edges 26 of the battery door 16 for positioning, retaining and securing the APT hearing aid 12 within the sleeve 10.

The battery door opening 50 is also sufficiently large to allow the battery door 16 to be opened wide, allowing the user to replace the battery 20 within the hearing aid shell 14 without removing the sleeve 10 from the hearing aid 12. In the preferred embodiment, the battery door opening 50 also exposes the microphone port 28 of the hearing aid shell 14. The distal sound outlet opening 48 is meanwhile less than ¼ inch tall, too small to be stretched to push the hearing aid 12 through the distal sound outlet opening 48 without damaging the sleeve 10. The four clip openings 52, 54, 56, 58 are less than $1/10^{th}$ of an inch in either direction, much too small for the hearing aid 12 to be pushed through any of the clip openings 52, 54, 56, 58. That is, the small size of the clip openings prevent the hearing aid 12 from disengaging from the sleeve 10 when the user pulls on the flexible filament 38 to remove the hearing aid 12 from the user's ear canal. When the flexible filament 38 is attached through two independent clip openings (one of 52 and 54 and one of 56 and 58), the sleeve 10 cannot be removed from the hearing aid 12 without first removing the flexibile filament 38 from the hearing aid 12, further ensuring that the hearing aid 12 does not disengage from the sleeve 10 at an unwanted time.

The sleeve 10 has an exterior profile which is sized and shaped for at least partial occlusion of the hearing aid 12 in the user's ear canal. Thus, the interaction between the sleeve 10 and the ear canal changes the hearing aid 12 from being largely non-occlusive to being substantially occlusive. The hearing aid 12, including its shell 14, can be inserted and removed from the sleeve 10 by the user, a helper or the user's audiologist, allowing the user to choose whether to use the hearing aid 12 in an occlusive or in a non-occlusive manner. The sleeve 10 permits the hearing aid position in the ear canal to be largely or entirely determined by the flexible filament positioning structure 38, consistently for both occlusive and non-occlusive use.

In the preferred embodiment, there are three thin fins 62, 64, 66 on each side of the sleeve 10 which engage with the ear canal tissue. The fins 62, 64, 66 extend generally normal or perpendicular to the insertion direction, and have significant flexibility to be easily bent for conforming with any particular user's ear canal shape. Each of the fins 62, 64, 66 is largely but not entirely circular, with each fin 62, 64, 66 extending only around a portion of the exterior profile of the sleeve 10. By extending around only a portion of the exterior profile of the sleeve 10, the fin shape naturally establishes a fold line 68 for the fin where the fin projects from the sleeve 10 in a generally linear attachment. This fold line 68 gives each fin 62, 64, 66 a natural fold direction, such that the projecting edge of the fin 62, 64, 66 can be readily deflected in the proximal-distal insertion direction. The largest fins are the proximal fins 62, which collectively are preferably about ½ inch wide and are each less than $1/50^{th}$ of an inch thick. The smallest fins are the distal fins 66, which collectively are preferably about ⅓ inch wide and are each less than $1/50^{th}$ of an inch thick. The middle set of fins 64 are likewise each less than $1/50^{th}$ of an inch thick, but have a collective width between the proximal fins width and the distal fins width. By using three substantially circular fins 62, 64, 66 on each side of the sleeve 10, narrowing in width from the proximal end to the distal end of the hearing aid 12, with each fin 62, 64, 66 having a natural fold line 68, the fins 62, 64, 66 have been found to lightly engage with the ear canal tissue of a large number of users to provide the occlusion benefit, i.e., to substantially restrict sound travel through air around the sides of the APT hearing aid 12.

The openings 52, 54, 56, 58 in the sleeve 10 for the flexible filament 38 are too small, and the material for the sleeve 10 not sufficiently flexible, to permit the entire hearing aid 12 to fit through the openings 52, 54, 56, 58 for the flexible filament 38. Thus, when the user pulls on the flexible filament 38 to remove the hearing aid 12 from the user's ear canal, the sleeve 10 comes out of the ear canal with the hearing aid 12. In other words, the interaction between the sleeve 10 and the flexible filament positioning structure 38 prevents disengagement of the sleeve 10 from the hearing aid shell 14 during insertion and removal of the hearing aid 12 from the user's ear canal. Instead, the sleeve 10 can only come apart from the hearing aid 12 after the flexible filament 38 is first unclipped from the hearing aid 12.

Figure 13:
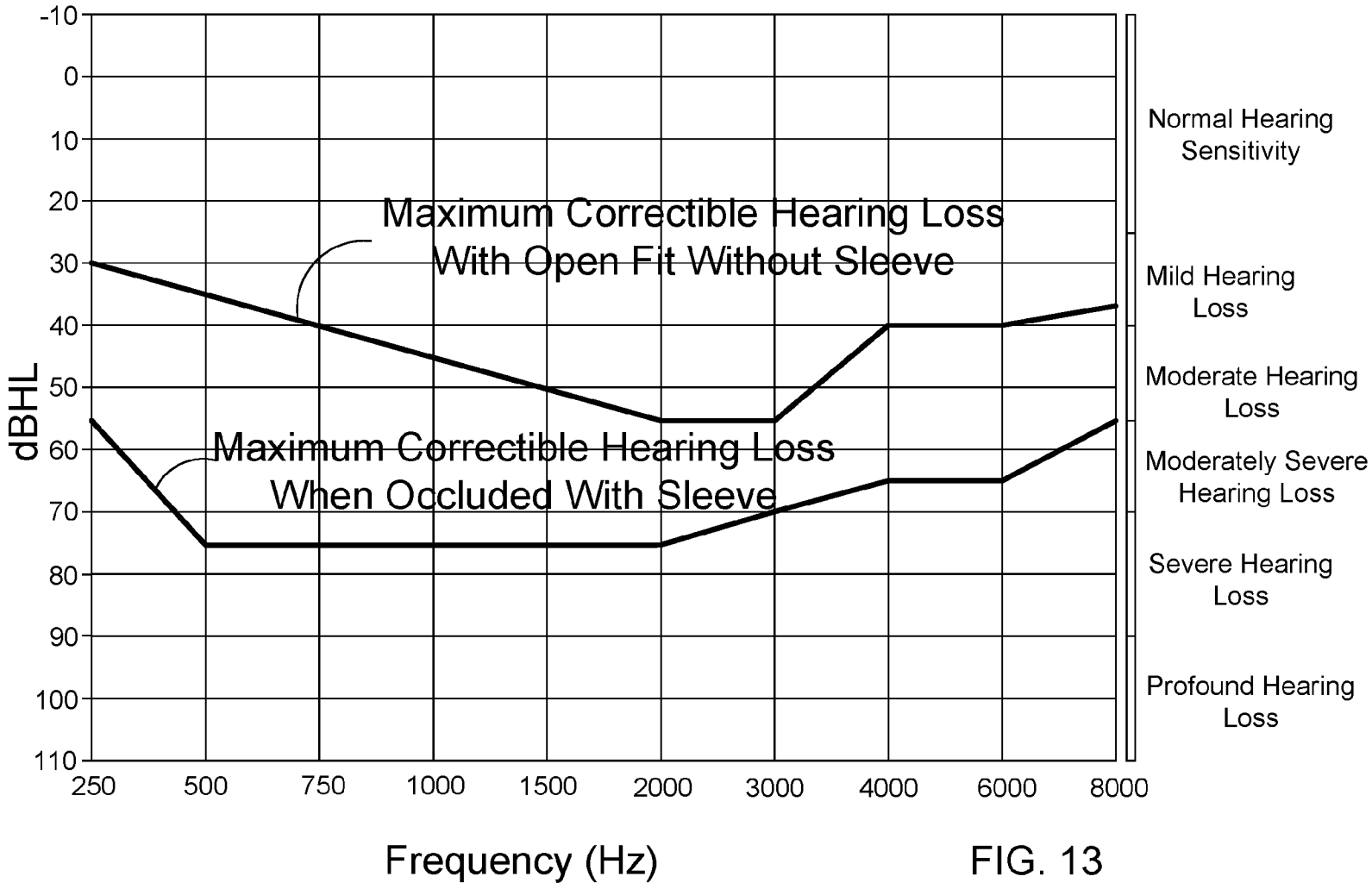
FIG. 13 is a plot of achievable gain versus frequency of the hearing aid of FIGS. 1 and 2, both with and without the hearing aid sleeve of the present invention as shown in FIGS. 3-12.

FIG. 13 shows a plot of achievable gain versus frequency of the preferred APT hearing aid 12, both with and without the preferred hearing aid sleeve 10 of the present invention. As can be seen, the hearing aid sleeve 10 increases the gain which can be applied within the hearing aid 12 at all frequencies, enabling fitting of the APT hearing aid 12 with patients having 15 to 35 decibels of more hearing loss. The additional gain which can be applied using the sleeve of the present invention is particularly needed and makes the APT hearing aid 12 ideal for patients having moderately severe and severe hearing loss. The additional gain achievable by use of the sleeve 10 provides a wider range of customers who can be fitted with the APT hearing aid 12.

Further, customers can select particularly times or events when they want to increase the gain on their hearing aid 12 and wear the occluding sleeve 10 (with one example being while attending a dramatic play or performance), and other particular times or events that they may not need the additional gain for the desired amount of hearing but prefer to use the hearing aid 12 in an unoccluded manner and benefit (with one example being while conversing on an airplane). While different users may find their particular hearing loss makes use of the sleeve 10 frequently or only occasionally desirable, each user is able to determine when to use and when not to use the sleeve 10.

Although the present invention has been described with reference to preferred embodiments, workers skilled in the art will recognize that changes may be made in form and detail without departing from the spirit and scope of the invention.

What is claimed is:

1. A hearing aid comprising:

a hearing aid shell with hearing aid electronics disposed therein, the hearing aid electronics including a battery and a receiver, the receiver projecting a hearing aid amplified audio output out of a sound output port on a distal side of the hearing aid shell, the hearing aid shell being sufficiently small to be substantially received in a user's ear canal without causing occlusion of the user's ear canal;

a flexible filament extending out of the hearing aid shell, the flexible filament extending outside the profile of the hearing aid shell, such that the filament interacts with a user's ear anatomy to determine an unoccluded insertion depth of the hearing aid shell into the user's ear canal by preventing the hearing aid from being pushed too deep into the ear canal by the user, the flexible filament permitting the user to remove the hearing aid from the user's ear canal by pulling on the flexible filament, with the flexible filament contacting the hearing aid shell over a filament/shell contact area and with pull force being directly transferred from the flexible filament to the hearing aid shell across the filament/shell contact area; and a sleeve receiving the hearing aid shell and formed of a material which is softer than the hearing aid shell, the sleeve being removably receivable on the hearing aid shell with the sleeve contacting the hearing aid shell over a sleeve/shell contact area which is larger than the filament/shell contact area, the sleeve comprising:

a sound outlet opening exposing the sound outlet port of the hearing aid shell;

an exterior profile sized for at least partial occlusion of the hearing aid in the user's ear canal; and a first filament opening around either the flexible filament or a portion of the hearing aid shell receiving the flexible filament, the first filament opening being too small for the hearing aid shell to pass therethrough, such that the small size of the first filament opening prevents the sleeve from disengaging from the hearing aid when the user pulls on the flexible filament to remove the hearing aid from the user's ear canal, with force for removal from the user's ear canal being transferred from the hearing aid shell to the sleeve across the sleeve/shell contact area.

2. The hearing aid of claim 1, wherein the exterior profile of the sleeve comprises at least one fin extending laterally relative to an insertion direction defined to have the sound output opening directed into the user's ear canal, with the fin being sized for at least partial occlusion of the hearing aid in the user's ear canal.

3. The hearing aid of claim 2, wherein the fin extends generally normal to the insertion direction.

4. The hearing aid of claim 3, comprising a plurality of fins, which each of the plurality of fins extending generally normal to the insertion direction.

5. The hearing aid of claim 1, wherein the hearing aid shell comprises a microphone port defined in the hearing aid shell permitting air carried sound to be sensed, and wherein the sleeve exposes the microphone port of the hearing aid shell.

6. A hearing aid comprising:

a hearing aid shell with hearing aid electronics disposed therein, the hearing aid electronics including a battery and a receiver, the receiver projecting a hearing aid amplified audio output out of a sound output port on a distal side of the hearing aid shell, the hearing aid shell being sufficiently small to be substantially received in a user's ear canal without causing occlusion of the user's ear canal;

a flexible filament extending out of the hearing aid shell, the flexible filament extending outside the profile of the hearing aid shell, such that the filament interacts with a user's ear anatomy to determine an unoccluded insertion depth of the hearing aid shell into the user's ear canal by preventing the hearing aid from being pushed too deep into the ear canal by the user, the flexible filament permitting the user to remove the hearing aid from the user's ear canal by pulling on the flexible filament; and a sleeve receiving the hearing aid shell and formed of a material which is softer than the hearing aid shell, the sleeve being removably receivable on the hearing aid shell, the sleeve comprising:

a sound outlet opening exposing the sound outlet port of the hearing aid shell;

an exterior profile sized for at least partial occlusion of the hearing aid in the user's ear canal; and a first filament opening around either the flexible filament or a portion of the hearing aid shell receiving the flexible filament, the first filament opening being too small for the hearing aid shell to pass therethrough, such that the small size of the first filament opening prevents the sleeve from disengaging from the hearing aid when the user pulls on the flexible filament to remove the hearing aid from the user's ear canal;

wherein the sleeve further comprises a battery opening which allows the user to replace the battery within the hearing aid shell without removing the sleeve from the hearing aid.

7. The hearing aid of claim 6, wherein the battery opening is sufficiently large to permit the hearing aid shell to be pushed therethrough for attachment and detachment of the sleeve on the hearing aid.

8. The hearing aid of claim 7, wherein the hearing aid shell comprises a battery door pivoting about a pivot axis for insertion and removal of the battery, with the battery door having a hinge side, a clasp side with a detent for snapping the battery door shut relative to the hearing aid shell, and two opposing edges running between the hinge side and the clasp side, wherein the opposing edges of the hearing aid door are narrower than the hearing aid shell, and wherein the sleeve comprises two lips adjacent the two opposing edges of the battery door, which two lips help to position and secure the hearing aid shell within the sleeve.

9. A hearing aid comprising:

a hearing aid shell with hearing aid electronics disposed therein, the hearing aid electronics including a battery and a receiver, the receiver projecting a hearing aid amplified audio output out of a sound output port on a distal side of the hearing aid shell, the hearing aid shell being sufficiently small to be substantially received in a user's ear canal without causing occlusion of the user's ear canal;

a flexible filament extending out of the hearing aid shell, the flexible filament extending outside the profile of the hearing aid shell, such that the filament interacts with a user's ear anatomy to determine an unoccluded insertion depth of the hearing aid shell into the user's ear canal by preventing the hearing aid from being pushed too deep into the ear canal by the user, the flexible filament permitting the user to remove the hearing aid from the user's ear canal by pulling on the flexible filament; and a sleeve receiving the hearing aid shell and formed of a material which is softer than the hearing aid shell, the sleeve being removably receivable on the hearing aid shell, the sleeve comprising:

a sound outlet opening exposing the sound outlet port of the hearing aid shell;

an exterior profile sized for at least partial occlusion of the hearing aid in the user's ear canal; and a first filament opening around either the flexible filament or a portion of the hearing aid shell receiving the flexible filament, the first filament opening being too small for the hearing aid shell to pass therethrough, such that the small size of the first filament opening prevents the sleeve from disengaging from the hearing aid when the user pulls on the flexible filament to remove the hearing aid from the user's ear canal;

wherein the sleeve comprises a battery opening which allows the user to replace the battery within the hearing aid shell without removing the sleeve from the hearing aid, wherein the battery opening is sufficiently large to expose the microphone port of the hearing aid shell.

10. A sleeve for removably receiving a hearing aid, comprising:

a body defining a chamber for encompassing a hearing aid, the body having an exterior profile sized for at least partial occlusion of the hearing aid in the user's ear canal;

a sound outlet opening defined on a distal end of the body, the sound outlet opening being too small for a rigid hearing aid shell sized to mate into the chamber to pass therethrough without damaging the sleeve;

a battery door opening defined on a proximal end of the body, the battery door opening being sufficiently large for a rigid hearing aid shell sized to mate into the chamber to pass therethrough without damaging the sleeve;

at least one lip around the battery door opening, the lip defining a width of the battery door opening which is smaller than a corresponding maximum width dimension of the chamber, such that the lip can be used to help to position and secure a hearing aid shell corresponding in size and shape to the chamber within the chamber; and a first filament opening separate from the sound outlet opening and separate from the battery door opening, the first filament opening being too small for a rigid hearing aid shell sized to mate into the chamber to pass therethrough without damaging the sleeve, such that the small size of the first filament opening prevents the sleeve from disengaging from a hearing aid in the chamber when a user pulls on the flexible filament to remove the sleeve containing the hearing aid from the user's ear canal;

wherein the sleeve is formed of a soft, flexible, shape-retaining material.

11. The sleeve of claim 10, wherein the chamber is oblong, and wherein the battery door opening is oblong.

12. The sleeve of claim 11, wherein the exterior profile of the sleeve comprises at least one fin extending laterally relative to an insertion direction defined to run between the sound outlet opening and the battery door opening, with the fin being sized for at least partial occlusion of the hearing aid in the user's ear canal.

13. The sleeve of claim 12, wherein the fin extends only around a portion of the exterior profile, so as to establish a fold line for the fin.

14. The sleeve of claim 13, wherein the fin extends generally normal to the insertion direction.

15. The sleeve of claim 14, comprising a plurality of fins on each of at least two broad sides of the chamber, which each of the plurality of fins extending generally normal to the insertion direction.

16. A method of outfitting a hearing aid for occlusion, comprising:

providing a hearing aid shell with hearing aid electronics disposed therein, the hearing aid electronics including a battery and a receiver, the receiver projecting a hearing aid amplified audio output out of a sound output port on a distal side of the hearing aid shell, the hearing aid shell being sufficiently small to be substantially received in a user's ear canal without causing occlusion of the user's ear canal;

removably inserting the hearing aid shell into a sleeve with the sleeve contacting the hearing aid shell over a sleeve/shell contact area, the sleeve being formed of a material which is softer than the hearing aid shell, the sleeve comprising:

a sound outlet opening exposing the sound outlet port of the hearing aid shell;

an exterior profile sized for at least partial occlusion of the hearing aid in the user's ear canal; and a first filament opening, the first filament opening being too small for the hearing aid shell to pass therethrough; and attaching a first filament to the hearing aid shell such that its attachment extends through the first filament opening, with the flexible filament contacting the hearing aid shell over a filament/shell contact area for direct transfer of pull force from the flexible filament to the hearing aid shell across the filament/shell contact area, the filament/shell contact area being smaller than the sleeve/shell contact area, such that the small size of the first filament opening prevents the sleeve from disengaging from the hearing aid when the user pulls on the flexible filament to remove the hearing aid from the user's ear canal.

17. The method of claim 16, wherein the attaching act attaches the first filament to the hearing aid shell in two locations, one on each end of the first filament.

18. The method of claim 17, wherein only one end of the first filament has its attachment extending through the first filament opening.

19. A method of outfitting a hearing aid for occlusion, comprising:

providing a hearing aid shell with hearing aid electronics disposed therein, the hearing aid electronics including a battery and a receiver, the receiver projecting a hearing aid amplified audio output out of a sound output port on a distal side of the hearing aid shell, the hearing aid shell being sufficiently small to be substantially received in a user's ear canal without causing occlusion of the user's ear canal;

removably inserting the hearing aid shell into a sleeve, the sleeve being formed of a material which is softer than the hearing aid shell, the sleeve comprising:

a sound outlet opening exposing the sound outlet port of the hearing aid shell;

an exterior profile sized for at least partial occlusion of the hearing aid in the user's ear canal; and a first filament opening, the first filament opening being too small for the hearing aid shell to pass therethrough; and attaching a first filament to the hearing aid shell such that its attachment extends through the first filament opening, such that the small size of the first filament opening prevents the sleeve from disengaging from the hearing aid when the user pulls on the flexible filament to remove the hearing aid from the user's ear canal;

wherein the sleeve further comprises a battery opening which allows the user to replace the battery within the hearing aid shell without removing the sleeve from the hearing aid.

20. The method of claim 19 wherein the battery opening is oblong and wherein the hearing aid shell is oblong, and wherein the removeable inserting act inserts the hearing aid shell into the sleeve through the battery opening.

* * * * *